United States Patent [19]

McDermott

[11] 4,420,876

[45] Dec. 20, 1983

[54] METHOD OF COIL ASSEMBLY FOR HOT MELT INDUCTION HEATER APPARATUS

[75] Inventor: Arthur W. McDermott, Maple Valley, Wash.

[73] Assignee: The Boeing Company, Seattle, Wash.

[21] Appl. No.: 260,970

[22] Filed: May 6, 1981

[51] Int. Cl.[3] ..... H05B 3/00

[52] U.S. Cl. ..... 29/611

[58] Field of Search ..... 219/10.79; 29/605, 611; 336/192, 223, 232

[56] References Cited

U.S. PATENT DOCUMENTS

| | | | |
|---|---|---|---|
| 2,222,729 | 11/1940 | Ver Planck et al. | 336/192 |
| 2,333,509 | 11/1943 | Barnes | 336/223 |
| 3,543,206 | 11/1970 | King | 29/605 |
| 3,737,990 | 6/1973 | Schut | 29/605 |
| 3,845,268 | 10/1974 | Sindt | 219/10.77 |
| 4,146,858 | 3/1979 | McDermott | 29/605 |

*Primary Examiner*—Carl E. Hall
*Assistant Examiner*—P. W. Echols
*Attorney, Agent, or Firm*—Conrad O. Gardner; B. A. Donahue; Nicolaas DeVogel

[57] ABSTRACT

An induction heating coil having fluoroplastic coated polyimide tape wrapped windings for providing a bonded, solid monolithic structure. The induction heating coil includes a cooling fin of predetermined length extending in interleaved relationship between a plurality of consecutive turns of current-carrying coil windings. A plurality of fluoroplastic coated polyimide sheets are fused to the coil body between the coil body and a fluoroplastic face sheet forming the outer wear surface of the induction heater coil, thereby providing a non-stick surface for release of hot melt adhesives.

7 Claims, 9 Drawing Figures

METHOD OF COIL ASSEMBLY FOR HOT MELT INDUCTION HEATER APPARATUS

Figure 1:
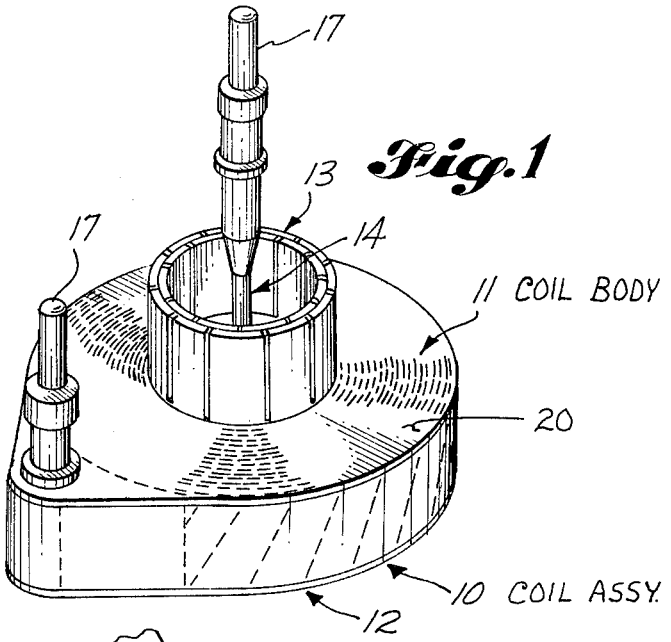

The present invention relates to coil assemblies, and more particularly to the method for making coil assemblies for use in hot melt induction heater apparatus, such as shown in U.S. Pat. No. 3,845,268, issued to Sindt, also assigned to The Boeing Company.

The prior art induction heater apparatus have included coil assemblies and methods for making coil assemblies such as shown and described in the afore-referenced U.S. Pat. No. 3,845,268. The coil assembly in the aforementioned patent can be seen to comprise 0.004-inch polyimide film spirally wound around $0.010 \times 0.375 \times 80$ copper strap to provide insulation between turns of the coil winding. Heat conducting fins shown in the afore-referenced patent comprise three one-inch lengths of #19 conductor flat cable. In the method of providing the coil assembly in the afore-referenced U.S. Pat. No. 3,845,268, the 0.010 thick copper strap is subsequently wound on a ⅜-inch diameter mandrel with adhesive being applied between each turn with cooling fins further interleaved between turns to provide the coil body. Such assembly along with a face sheet is clamped and subsequently cured for about two hours at 180° F. to provide the coil assembly which is subsequently inserted into the coil housing structure.

It is accordingly an object of the present invention to provide electrical insulation between copper strap coil windings 11 comprising double-sided fluoroplastic resin-coated polyimide tape 16 spirally wound around the copper strap 16 induction coil turns, thereby providing an integral monolithic structure of increased bond strength.

It is a further object of the present invention to provide heat dissipation means in an induction heating coil assembly 10 comprising a predetermined length of conductive material 13 interleaved between a plurality of current conducting turns.

It is a further object of the present invention to provide a coil assembly 10 including coil body 11 and face sheet 12 which is fused together at a temperature of 700° F. to provide a solid monolithic coil assembly structure.

Figure 2:
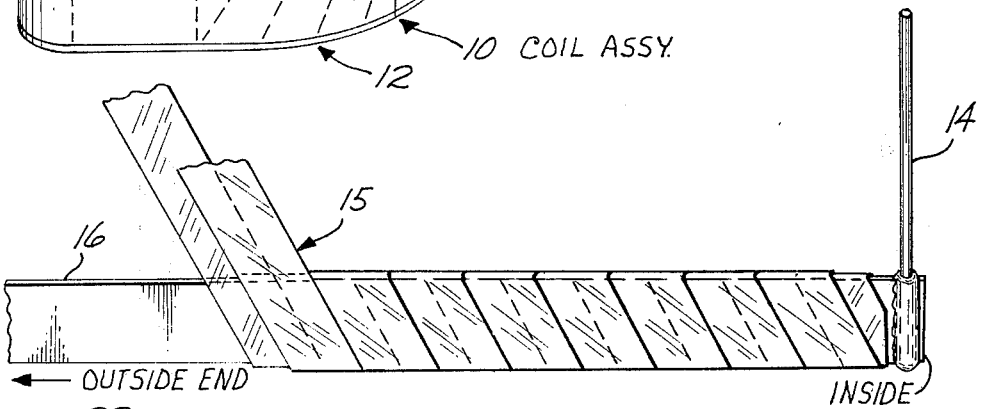
Figure 3:
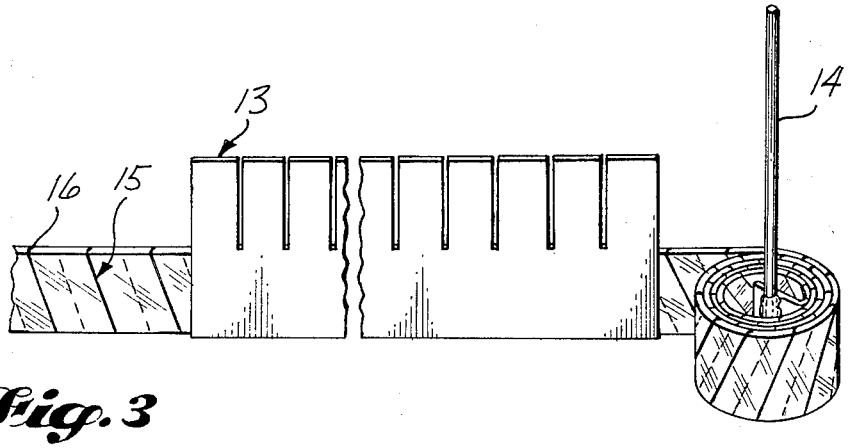
Figure 4:
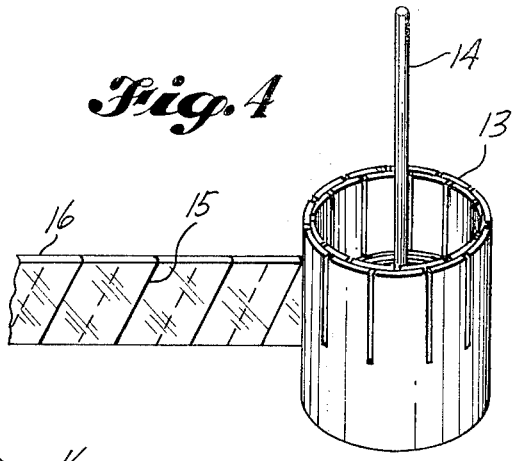
Figure 5:
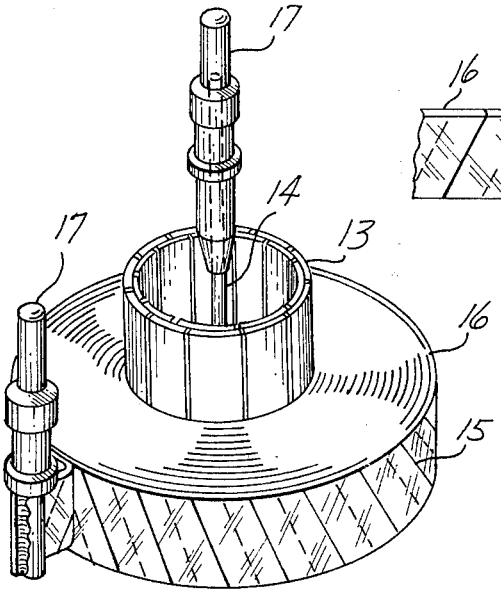
Figure 6:
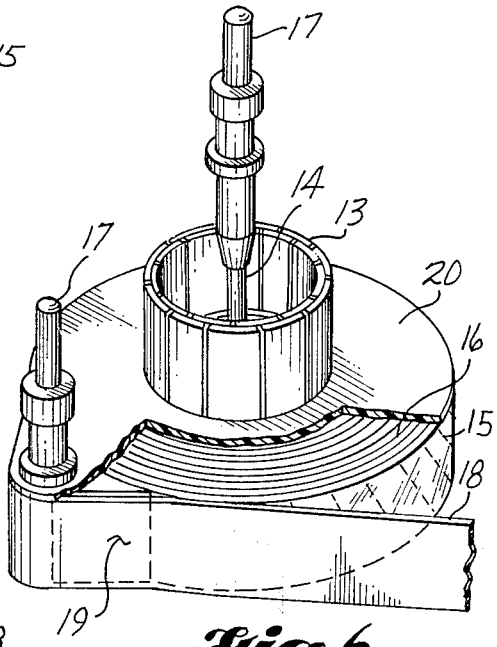
Figure 7:
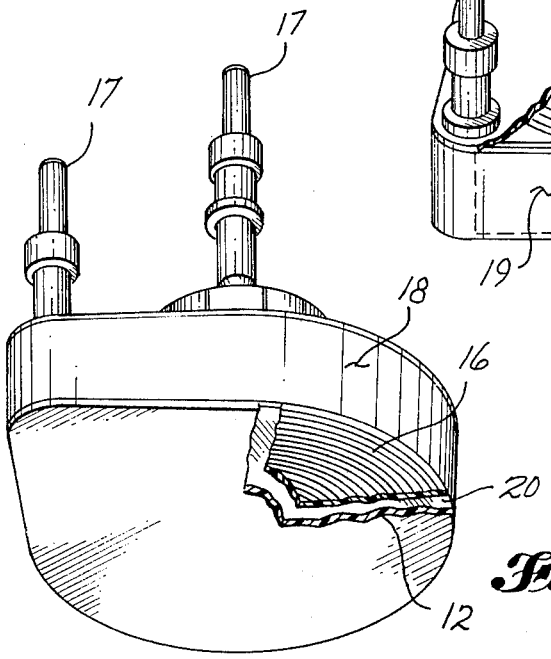
Figure 8:
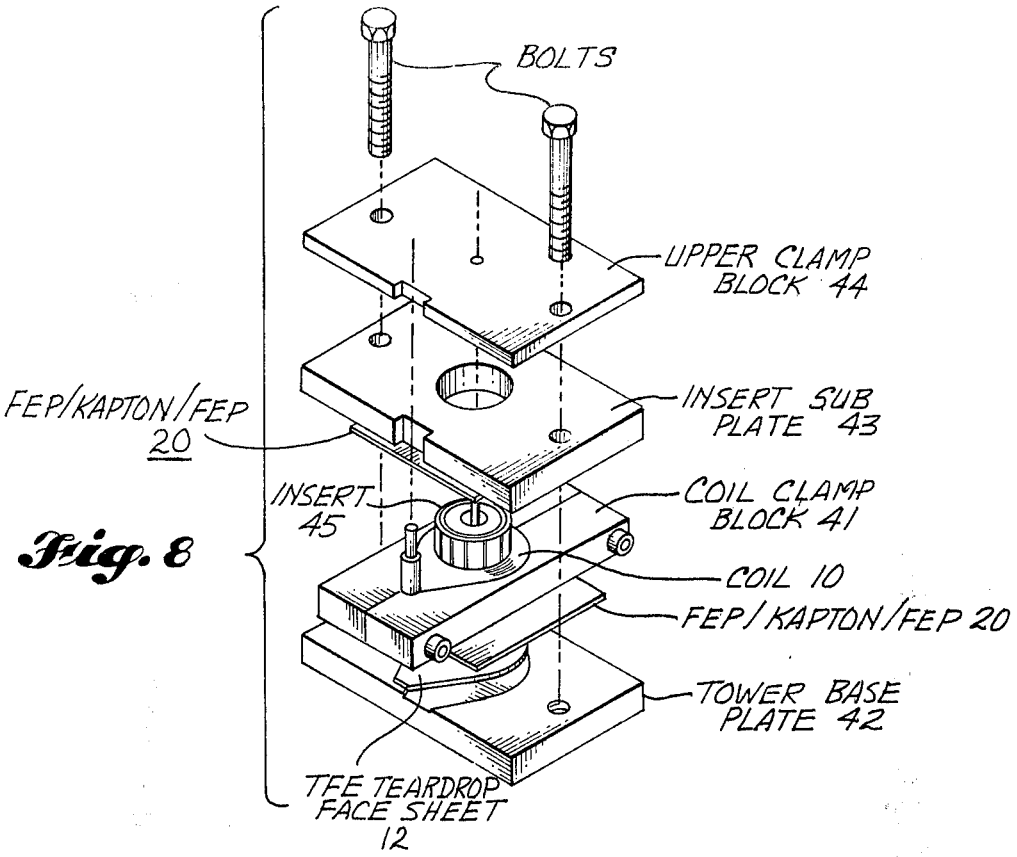
Figure 9:
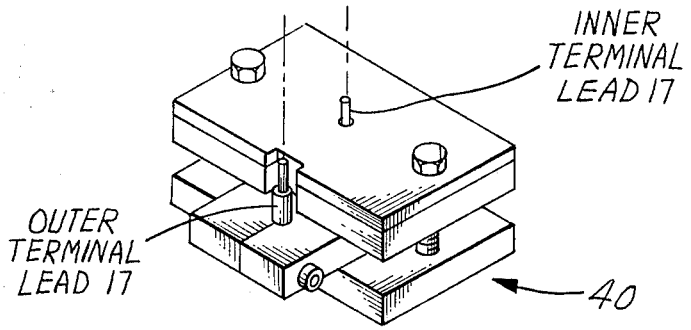

A full understanding of the present invention, and of its further objects and advantages and the several unique aspects thereof, will be had from the following description when taken in conjunction with the accompanying drawings in which:

FIG. 1 is a perspective view of a preferred embodiment of the present coil assembly 10 made in accordance with the present method, and fused at the predetermined temperature;

FIG. 2 is illustrative of a method step for making the present coil assembly 10 showing the application of doublesided fluoroplastic resin coated polyimide tape 15 to a copper strap 16 turn winding, further showing an inner brazed terminal lead 14;

FIG. 3 is illustrative of a further method step for making the present coil assembly 10 showing interleaving of a predetermined length of cooling fin 13 structure between turns of the coil body 11;

FIG. 4 is illustrative of a method step showing cooling fin 13 winding between turns 5, 6, and 7 of the coil body 11;

FIG. 5 is a perspective view illustrative of the coil body 11 subsequent to the winding step (prior to fusing);

FIG. 6 is a perspective view illustrative of the coil body 11 portion of the assembly further showing back coil body 11 with insulation sheets 20 and further showing terminal wedge inserts 19 disposed about the outer brazed terminal lead 17;

FIG. 7 is illustrative of the coil body 11 subsequent to the method steps of disposing the fluorinated ethylene propylene coated fluoroplastic resin face sheet 12 on the front surface of the coil body 11 and further including a showing of the outer banding 18 in position surrounding the coil body 11;

FIG. 8 is an exploded view of the coil fusing fixture 40 also showing the coil assembly 10 disposed therein; and, FIG. 9 is illustrative of the assembled coil fusing fixture 40, with coil assembly 10 in place.

First, as an introduction, it should be recognized that induction heating type coils differ from EMR (electromagnetic riveting) coils such as shown in prior art U.S. Pat. No. 4,146,858 to McDermott and U.S. Pat. No. 3,737,990 to Schut, both assigned to The Boeing Company, in that induction heating coils are utilized to provide an induction heat source rather than utilization to provide high-strength magnetic force fields to impart physical energy.

The present induction heater coil assembly is shown in perspective in FIG. 1 to help provide a general overview of several important features thereof. It will be noted that the present coil assembly 10 includes insulatively wrapped copper windings 11. The insulative wrapping step of copper windings 11 will be hereinafter described in more detail in connection with the method of making the coil assembly; however, it should be noted here that the insulating wrapping consists of a polyimide tape 15 having double-sided fluoroplastic resin coatings. A double-sided fluoroplastic resin coated polyimide tape called FEP-Teflon Coated Kapton Tape is manufactured by the E. I. Du Pont Company of Wilmington, Del. with nomenclature number 200F919. Also in FIG. 1 shown on the front or face surface which is the working surface of coil assembly 10 is a fused non-stick face sheet 12 which will not adhere to hot melt fasteners. Face sheet 12 may comprise a 0.032-inch thick fluoroplastic resin material also known as TFE-Teflon which is a fluorinated ethylene propylene material manufactured by the E. I. Du Pont Company of Wilmington, Del. Coil assembly 10 in FIG. 1 is also seen to include a solid one-piece cooling fin 13 of predetermined length interleaved among insulatively wrapped copper windings 11. An inner high temperature brazed terminal lead 14 is also seen connected between coil assembly 10 via the windings 11 to an outer coil terminal 17. It should be noted here that the hereinbeforedescribed structural members when wound insulatively, clamped, and fixtured as described hereinafter in the step-by-step method for making coil assembly 10 provide a coil having a homogeneous mass, superior bond strength, and improved electrical characteristics.

COIL ASSEMBLY 10 FABRICATION PROCEDURE

In the hereinafter-described method of making coil assembly 10, all parts, tools and materials utilized in the fabrication process should be properly degreased, cleaned and handled in a clean environment.

In the step-by-step method for making coil assembly 10, a number 12 bare copper wire having a length of one and one-half inches as shown at 14 in FIG. 2 is brazed to the inside end of an 0.010×0.375×90 ETP (electrical tough pitch) grade copper strip 16 using 800° F. silver solder (such as manufactured by the Handy/Harmon Company). Subsequent to the brazing of the inner terminal lead 14 to copper strap 16, inner lead 14 and copper strap 16 are cleaned with MEK (a methyl-ethyl-ketone cleaner), and then abraded with an abrasive pad, e.g., Scotchbrite as manufactured by the 3M Company, to remove all burrs and oxidation.

Copper strap 16 is then ready to be spirally wrapped with FEP-Teflon (a fluoroplastic resin, more specifically perfluoroalkoxyethylene) coated Kapton polyimide tape 15 (identified as number 200F919 and manufactured by the Du Pont Company of Wilmington, Del.). As seen in FIG. 2, tape 15 is spirally wrapped about copper strap 16 with an overlap of between about 40 to 50 percent. Inner terminal lead 14 is now inserted into a ⅜ diameter coil winding mandrel (not shown), and five clockwise turns are made under tension with tape 15 covered copper strap 16. At this point in the fabrication procedure, cooling fin 13 as shown in FIG. 3, which cooling fin 13 has been previously cleaned and abraded, is interleaved as shown in FIG. 3 and wound between the next two consecutive turns of copper strap 16 as seen in FIG. 4. Winding of the remaining length of copper strap 16 in FIG. 4 is continued under tension until the entire 80-inch length thereof is fully wound, whereupon the winding is clamped with a restraining ring (not shown) so that, as seen in FIG. 5, the last ⅜-inch length of copper strap 16 may be bent back and formed at a 90° angle with respect to the coil windings to form the outer terminal lead termination.

Male terminal leads 17 (identified as Part No. 48-1871-02, manufactured by Amphenol-North American, Oak Brook, Ill.) are then soldered to the end of copper strap 16 and to the inner terminal lead 14, respectively, utilizing the aforementioned type 800° F. silver solder.

The clamp restraining ring which holds the coil together (not shown) is then removed, and the outer periphery of the coil is taped with pressure sensitive tape 18 (such as Kapton-100H manufactured by the Du Pont Company of Wilmington, Del.). A pair of terminal wedges 19 (only one shown in FIG. 6) which are made of a fluoroplastic resin (identified as TFE-Teflon, manufactured by the Du Pont Company of Wilmington, Del., and known more specifically as fluorinated ethylene propylene) are inserted on both sides of outer terminal lead 17 to reinforce and prevent movement thereof whereupon the periphery of the coil body is wound with three to six layers of FEP-Kapton tape (#200F919, identified earlier as manufactured by the Du Pont Company of Wilmington, Del.) shown as 18 in FIG. 7.

Turning now to the exploded view of the coil fusing fixture 40 shown in FIG. 8, it can be seen that the outside diameter of coil body 10 is clamped with fusing fixture clamp block 41 whereupon insulation sheet 20 comprised of one layer of FEP-Kapton film (type number 300F929, manufactured by the Du Pont Company of Wilmington, Del.) is then applied to both front and back coil faces, followed by application of face sheet 12 (as seen in FIG. 7), face sheet 12 being a 0.032-inch thick sheet of TFE-Teflon material, a fluoroplastic resin known more specifically as perfluoroalkoxyethylene, and manufactured by the Du Pont Company of Wilmington, Del.

Coil body 10 and coil clamp block 41 are then inserted on fusing fixture base plate 42, with coil face sheet 12 centered in the recess. The following steps in the fabrication process are then taken, (1) insert 45 is placed over inner terminal lead 17, and behind cooling fins 13, (2) insert sub-plate 43 is positioned over insert 45, (3) upper clamp block 44 is positioned over insert subplate 43, (4) then all plates are bolted through utilizing an application of approximately 40-inch pounds torque.

Coil fusing fixture 40 is pre-coated with a parting agent, e.g., Fre-Kote, that will not affect the quality of fusing and bond strength of the heating coil 10 (a parting agent manufactured by the Fre-Kote Manufacturing Company of Boca Raton, Fla.).

Coil assembly 10, now fixtured in coil fusing fixture 40, is then inserted into a vacuum furnace with coil face down, evacuation is done to a minimum of about 26 to 29 inches Hg., whereupon heat is then applied to a temperature of 650° F.±25° F. for about 30 minutes, and subsequently the temperature is raised to 700° F.±25° F. for about 30 minutes causing fusing and melting of FEP/TFE resins, while at the same time burning off impurities which would adversely affect bond strength; whereupon first cooling is done to 225° F. in an inert atmosphere to solidify FEP/TFE resins thereby protecting against contamination of all components before the fluorocarbon resins have solidified (argon or helium purge preferred). Coil assembly 10 and coil fusing fixture 40 (the assembled coil fusing fixture as shown in FIG. 9) are then removed from the furnace and cooled in atmosphere to room temperature. Coil fixture 40 is then disassembled and coil fusing assembly 10 removed. Excess material flash on the outer edges of face sheet 12 are then trimmed net, thereby completing the fabrication process.

When rapid cycling of coil 10 occurs, then fin 13 which would accumulate heat under such conditions should be interleaved between turns of coil 10.

What is claimed is:

1. The method of making an induction heating coil (10) comprising the steps of:

providing a conductor (16) having a rectangular cross sectional area and an inside end;

brazing an inner terminal lead (14) to said inside end of said conductor (16) with a high-temperature braze alloy;

wrapping said conductor (16) by winding in spiral overlap fashion a polyimide tape (15) around said conductor (16) said polyimide tape (15) having a fluorocarbon resin coating on both sides;

winding under tension a plurality of turns of said conductor (16) so that opposing surfaces of said fluorocarbon resin coatings between windings of said conductor (16) are in direct contact;

after winding of the last conductor turn (16), forming of an outer terminal lead at 90° to the coil body (11), and subsequently high temperature brazing inner (17) and outer (17) terminals to said leads; inserting wedges (19) to stabilize said outer terminal lead (17), and then winding a further plurality of turns on the coil periphery with dielectric polyimide tape (18).

2. The method of claim 4 comprising the further steps of positioning polyimide insulation sheets (20) on front and back surfaces of said coil body (11), subsequent to wrapping said plurality of turns of 16 and prior to the application of a heating step.

3. The method according to claim 2 including adding a further fluorocarbon face sheet (12) to the coil face to provide a non-stick surface prior to application of said heating step.

4. The method of clamping and fixturing (40) of the induction elements of said heating coil (10) of claim 7 prior to application of said heating step thereby providing maximum clamping pressure and desired alignment of said induction heating coil (10).

5. The method of heating said plurality of turns of said conductor (11), and face sheet (12) and insulation sheet (20) in combination, while clamped and fixtured (40) according to claim 8, said method including using a vacuum furnace to heat the resins to 700° F.+25−0 causing melting and fusing of said opposing surfaces, while at the same time burning off impurities which would adversely affect bond strength.

6. The method of claim 5 including cooling said heating coil (10) in an inert atmosphere thereby protecting against contamination of all components before the fluorocarbon resins have solidified.

7. The method of claim 6 including applying a parting agent to coil fusing fixture (40) without affecting quality of fusing, and bond strength of said heating coil (10).

* * * * *